US006462317B1

(12) United States Patent
Foote et al.

(10) Patent No.: US 6,462,317 B1
(45) Date of Patent: Oct. 8, 2002

(54) HEATER BAR UTILIZING A POSITIVE TEMPERATURE COEFFICIENT HEATING ELEMENT

(75) Inventors: Wayne E. Foote, Eagle, ID (US); David J. Arcaro, Boise, ID (US); Jeffrey S. Weaver, Ft. Collins, CO (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/848,787

(22) Filed: May 3, 2001

(51) Int. Cl.[7] ..... H05B 3/00

(52) U.S. Cl. ..... 219/505; 219/216; 219/520; 399/329; 399/333

(58) Field of Search ..... 219/520, 505, 219/216, 552, 553, 546, 548, 469; 399/329, 333

(56) References Cited

U.S. PATENT DOCUMENTS

| | | | | |
|---|---|---|---|---|
| 4,996,567 A | | 2/1991 | Watarai et al. | 355/290 |
| 5,481,089 A | | 1/1996 | Furuta | 219/497 |
| 5,499,087 A | * | 3/1996 | Hiraoka et al. | 355/285 |
| 5,844,694 A | | 12/1998 | Miura | 358/468 |
| 5,986,241 A | | 11/1999 | Funahashi | 219/497 |
| 6,114,672 A | * | 9/2000 | Iwasaki et al. | 219/505 |
| 6,172,699 B1 | | 1/2001 | Ohashi | 347/171 |

OTHER PUBLICATIONS

Bahle Corporation pamphlet; pp. 1–10.

PTC Thermistors.

PTC Thermistors: Type YH Self–Regulating Heater; Datasheet D–YH–3.

* cited by examiner

*Primary Examiner*—Teresa Walberg
*Assistant Examiner*—Shawntina Fuqua
(74) *Attorney, Agent, or Firm*—James R. McDaniel

(57) ABSTRACT

This invention relates to an improved heater bar that can be used for either a heater in a laser printer fuser or a heater in a thermal overcoat or laminating mechanism. The improved heater bar utilizes a positive temperature coefficient (PTC) thermistor element to produce the heat output.

17 Claims, 2 Drawing Sheets

HEATER BAR UTILIZING A POSITIVE TEMPERATURE COEFFICIENT HEATING ELEMENT

FIELD OF THE INVENTION

This invention relates to an improved heater bar that can be used for either a heater in a laser printer fuser or a heater in a thermal overcoat or laminating mechanism. The improved heater bar utilizes a positive temperature coefficient (PTC) thermistor element to produce the heat output.

DESCRIPTION OF THE RELATED ART

It is known, in printing devices, to measure the temperature of the print head. Exemplary of such prior art are U.S. Pat. No. 4,996,567 ('567) to S. Watarai et al., entitled "Method of Controlling Fuser Unit of Image Forming Apparatus," U.S. Pat. No. 5,481,089 ('089) to H. Furuta, entitled "Heater Control Device for Image Forming Apparatus," U.S. Patent No. 5,844,694 ('694) to S. Miura, entitled "Facsimile Apparatus," U.S. Pat. No. 5,986,241 ('241) to N. Funahashi, entitled "Heating Control System for Heater Provided in Laser Printer," and U.S. Pat. No. 6,172,699 ('699) to T. Ohashi, entitled "Thermal Printing System Having Function for Preventing Over Heating of Thermal Head." All of the above references are concerned with measuring the temperature of a device with a sensor and then controlling the temperature of the device with some type of feedback control circuit. Consequently, a more advantageous system, then, would be presented if the temperature sensor and feedback control circuit were eliminated.

It is also known to employ positive temperature coefficient (PTC) thermistors. These devices have a resistance-temperature characteristic that exhibits a very small negative temperature coefficient until the device reaches a critical temperature, which is referred to as its "Curie", switch or transition temperature. As this critical temperature is approached, the devices begin to exhibit a rising, positive temperature coefficient of resistance as well as a large increase in resistance. This resistance change can be as much as several orders of magnitude within a temperature span of a few degrees.

It is further known to use PTC thermistors in heater bars. The Bahle Corp. of Puchon, Korea employs PTC thermistors in thermal binding machines and laminating machines. In these machines, the PTC thermistor is located in the heating element. However, due to the nature of the heating element, the heating element has a lot of thermal mass and would take some time to heat up. Also, there is no good thermal connection between the PTC thermistor and the frame. In fact, all the elements used to hold the PTC thermistor in place act as an insulator between the PTC thermistor and the frame. Consequently, a more advantageous system, then, would be presented if the amount of thermal mass and insulation were substantially reduced.

It is apparent from the above that there exists a need in the art for a heater bar which is lightweight through simplicity of parts and uniqueness structure, and which at least equals the heating characteristics of the known heaters, particularly those which employ the highly advantageous PTC thermistor, but which at same time avoids the use of temperature sensors and feedback control circuits. It is a purpose of this invention to fulfill this and other needs in the art in a manner more apparent to the skilled artisan once given the following disclosure.

SUMMARY OF THE INVENTION

Generally speaking, this invention fulfills these needs by providing a heater bar assembly, comprising a non-heat conductive frame means, a frame stabilizer means operatively connected to one side of the frame means, a positive temperature coefficient thermistor means located substantially within another side of the frame means, and an electrical conductor means located substantially adjacent to the thermistor means and the frame means.

In certain preferred embodiments, the frame means is constructed of any suitable polymeric material that is capable of withstanding temperatures of at least 150 degrees C. Also, the frame stabilizer means is constructed of any suitable material that is capable of keeping the frame from distorting. Finally, the electrical conductor means includes metallic, electrical conductors located on each side of the thermistor to provide electricity to the thermistor and a low thermal conducting material that is used to hold the metallic conductors and the thermistor in place.

In another further preferred embodiment, the heater of the present invention is capable of providing a uniform temperature along the length of the heater even when using narrow media with a wide heater.

The preferred heater bar, according to this invention, offers the following advantages: lightness in weight; ease of assembly and repair; elimination of temperature controls; temperature uniformity; reduced chance of over heating; excellent economy; increased reliability; good stability; good durability; and ease of power output adaptation. In fact, in many of the preferred embodiments, these factors of lightness in weight, ease of assembly and repair, elimination of temperature controls, temperature uniformity, reduced chance of over heating, reliability, economy, and power output adaptation are optimized to an extent that is considerably higher than heretofore achieved in prior, known heater bars.

The above and other features of the present invention, which will become more apparent as a description proceeds, are best understood by considering the following detailed description in conjunction with the accompanying drawings, wherein like characters represent like parts throughout the several views and in which:

DETAILED DESCRIPTION OF THE INVENTION

Figure 1:
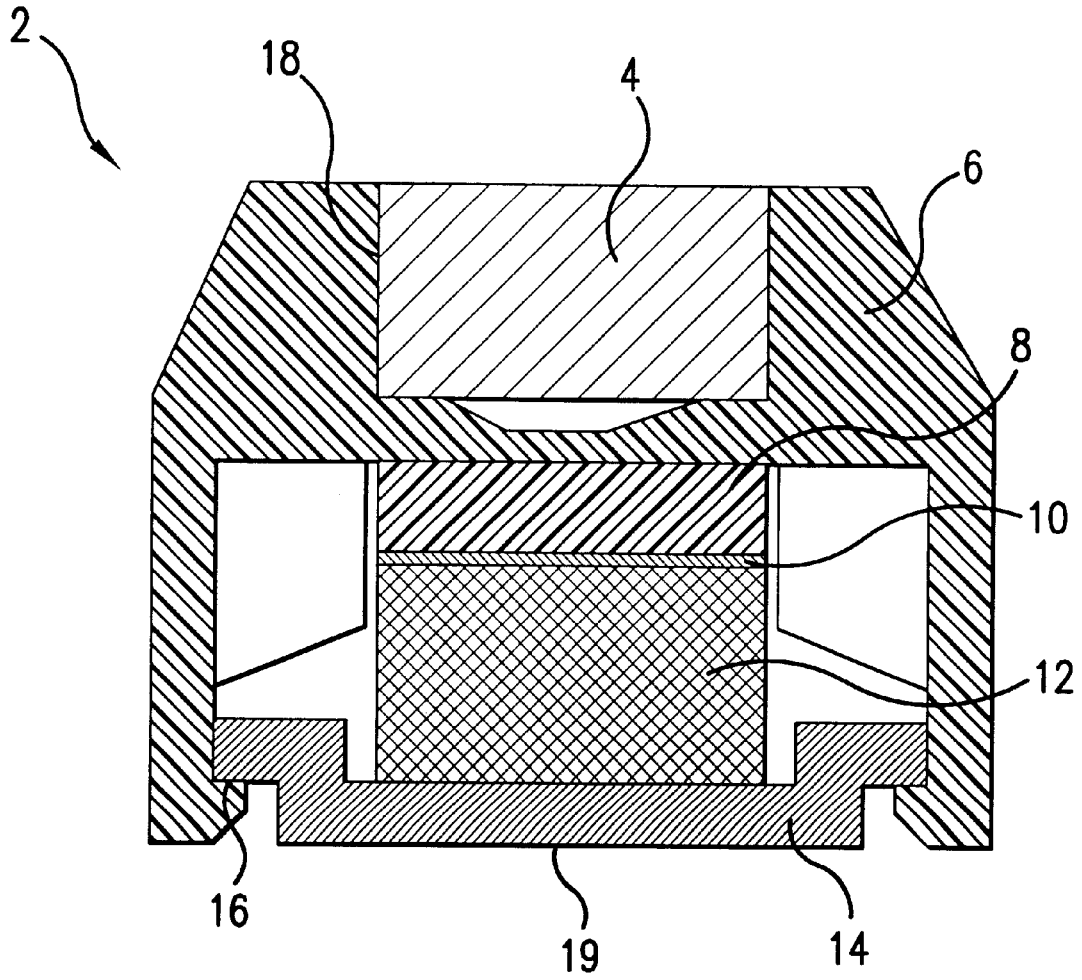
FIG. 1 is an end view of a heater bar utilizing a positive temperature coefficient thermistor, according to one embodiment of the present invention.
Figure 2:
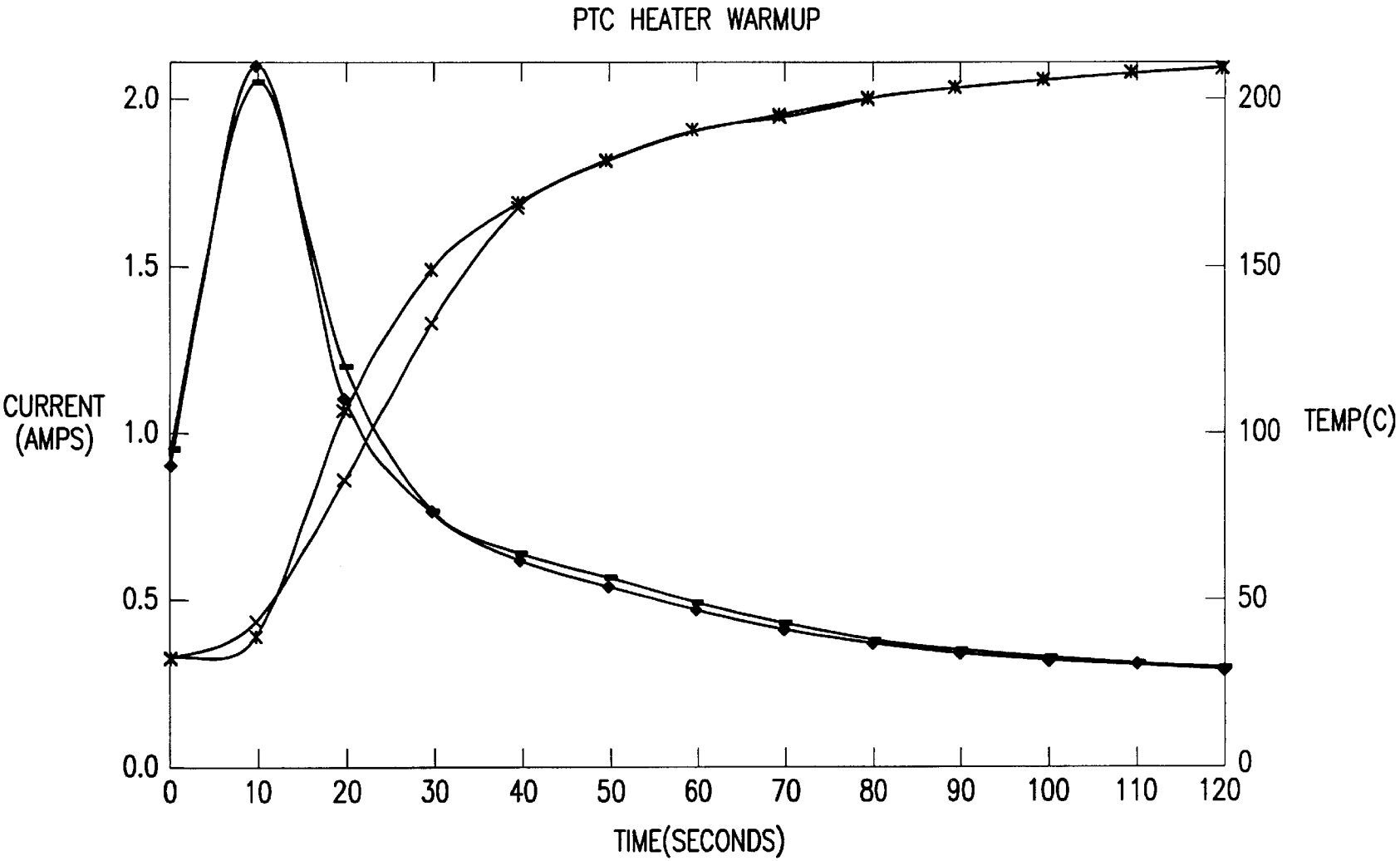
FIG. 2 is a graphical illustration of time (in seconds) vs. current (in amps) that shows the operating characteristics of the heater bar, according to the present invention.

With reference first to FIG. 1, there is illustrated one preferred embodiment for use of the concepts of this invention. FIG. 1 illustrates heater bar assembly 2. In particular, heater bar assembly 2 includes, in part, stabilizer bar 4, frame 6, retainer 8, electrical conductor 10, positive temperature coefficient (PTC) thermistor 12, electrical conductor or shoe 14, flange 16, channel 18, and surface 19.

Stabilizer bar 4 is, preferably, constructed of any suitable, rigid material that acts as a stiffener for frame 6. In the present invention, 10 stabilizer bar 4, is, preferably, constructed of stainless steel. The purpose of stabilizer bar 4 is to allow a load to be placed upon frame 6 without distorting frame 6.

Frame 6, preferably, is constructed of any suitable, non-heat conductive, lightweight, inexpensive material that is capable of withstanding temperatures of at least 150 degrees C. In the present invention, frame 6, preferably, is constructed of a polymeric material, such as polyphenylene sulfide (PPS). Frame 6 also includes flanges 16 and channel 18 which are conventionally constructed in frame 6.

Retainer 8, preferably, is constructed of any suitable, low thermally conductive material. In the present invention, retainer 8, preferably, is constructed of silicon rubber. Retainer 8 acts as a "spring" in order to keep the conductor 10 and thermistor 12 pressed against frame 6 and conductor 14 in order to provide good electrical conduction between thermistor 12 and conductors 10 and 14. Conductor 10, preferably, is constructed of any suitable, electrically conductive material. In the present invention, conductor 10, preferably, is constructed of copper foil.

Thermistor 12, preferably, is constructed of any suitable, positive temperature coefficient (PTC) material. As described above and with respect to the present invention, thermistor 12 provides excellent heating characteristics for heater bar assembly 2.

Conductor or shoe 14, preferably, is constructed of the same material as conductor 10, but conductor 14 is thicker. Conductor 14 interacts with flanges 16 of frame 6 in order to retain retainer 8, conductor 10, and thermistor 12 within frame 6. It is to the understood that conductor 14 could be rigidly attached to thermistor 12 or thermistor 12 could merely be placed on conductor 14 prior to locating conductor 14 adjacent to flanges 16. Also, it is to be understood that conductor 14 can either be conventionally hard plated or conventionally covered with a low friction material, such as Teflon®, to provide a hot surface 19 for fusing, over coating or laminating.

As discussed above, heater bar assembly 2 can be used for either a heater in a laser printer fuser or a heater in a thermal or laminating mechanism. The present invention utilizes a PTC thermistor 12 to produce the heat output. Thermistor 12 has the property of increasing resistance dramatically when it reaches its Curie temperature. The Curie temperature of thermistor 12 can be tailored such that heater bar assembly 2 will operate at a desired temperature based upon the construction of thermistor 12.

In operation, a line voltage (not shown) is conventionally applied to thermistor 12. At room temperature, thermistor 12 has low resistance so the resulting large current will produce large $I^2R$ losses in thermistor 12 that results in rapid heating of thermistor 12 and heater bar assembly 2. When thermistor 12 reaches its Curie temperature, the resistance of thermistor 12 will increase dramatically and switch off thermistor 12. Consequently, the temperature of heater bar assembly 2 will be maintained without any secondary temperature control, regulation or measurement devices.

The thermal mass of heater bar assembly 2 has been minimized in the present invention to produce an instant-on heating element. As shown in FIG. 1, thermistor 12 is in direct contact with conductor 14. Conductor 14 also acts as an electrical conductor to provide power to one side of thermistor 12. Conductor 10 is provided between thermistor 12 and retainer 8 to provide power to the opposite side of thermistor 12.

With respect to the present invention, the present invention offers the following advantages:

1.) No temperature controls required—Heater bar assembly 2 will maintain the design temperature without the need of an active temperature control system.

What is claimed:

1. A heater bar assembly, comprising:

a non-heat conductive frame means;

a frame stabilizer means operatively connected to one end of said frame means;

a positive temperature coefficient thermistor means located within another end of said frame means;

an electrical conductor means located adjacent to said thermistor means and said frame means, said electrical conductor means further comprising; a first electric conductor located adjacent to one side of said thermistor means, and a second electrical conductor located adjacent to another side of said thermistor means and said another end of said frame means; and a retainer means located adjacent to said frame means and said second electrical conductor.

2. The assembly, as in claim 1, wherein said frame means is further comprised of:

3 a polymeric material.

3. The assembly, as in claim 2, wherein said polymeric material is further comprised of:

polyphenylene sulfide.

4. The assembly, as in claim 1, wherein said frame means is capable of withstanding temperatures of at least 150 degrees C.

5. The assembly, as in claim 1, wherein said frame means is further comprised of:

a channel located substantially adjacent to said frame stabilizer means; and a flange means located substantially adjacent to said electrical conductor means.

6. The assembly, as in claim 1, wherein said frame stabilizer means is further comprised of:

a metallic material.

7. The assembly, as in claim 6, wherein said metallic material is further comprised of:

stainless steel.

8. The assembly, as in claim 1, wherein said thermistor means is further comprised of:

a single thermistor.

9. The assembly, as in claim 1, wherein said thermistor means is further comprised of:

a plurality of thermistors.

10. The assembly, as in claim 1, wherein said first electrical conductor is further comprised of:

an electrically conductive metallic foil.

11. The assembly, as in claim 10, wherein said foil is further comprised of:

copper.

12. The assembly, as in claim 1, wherein said second electrical conductor is further comprised of:

a shoe.

13. The assembly, as in claim 12, wherein said shoe is further comprised of:

copper.

14. A heater bar assembly for a laser printer, comprising:

a non-heat conductive frame means;

a frame stabilizer means operatively connected to one end of said frame means;

a positive temperature coefficient thermistor means located within another end of said frame means;

an electrical conductor means located adjacent to said thermistor means and said frame means, said electrical conductor means further comprising; a first electric conductor located adjacent to one side of said thermistor means, and a second electrical conductor located adjacent to another side of said thermistor means and said another end of said frame means; and a retainer means located adjacent to said frame means and said second electrical conductor.

15. The assembly, as in claim 14, wherein said frame means is capable of withstanding temperatures of at least 150 degrees C.

16. A heater bar assembly for a thermal laminating mechanism, comprising:

a non-heat conductive frame means;

a frame stabilizer means operatively connected to one end of said frame means;

a positive temperature coefficient thermistor means located within another end of said frame means;

an electrical conductor means located adjacent to said thermistor means and said frame means, said electrical conductor means further comprising; a first electric conductor located adjacent to one side of said thermistor means, and a second electrical conductor located adjacent to another side of said thermistor means and said another end of said frame means; and a retainer means located adjacent to said frame means and said second electrical conductor.

17. The assembly, as in claim 16, wherein said frame means is capable of withstanding temperatures of at least 150 degrees C.

* * * * *